US006270423B1

(12) United States Patent
Webb

(10) Patent No.: US 6,270,423 B1
(45) Date of Patent: Aug. 7, 2001

(54) GOLF CLUB HEAD WITH STRIKING SURFACE DENSITY CONTROL

(76) Inventor: James H. Webb, 790 S. Acoma Blvd., Lake Havasu City, AZ (US) 84606

( * ) Notice: Subject to any disclaimer, the term of this patent is extended or adjusted under 35 U.S.C. 154(b) by 0 days.

(21) Appl. No.: 08/997,192

(22) Filed: Dec. 11, 1997

Related U.S. Application Data

(60) Provisional application No. 60/057,312, filed on Sep. 2, 1997.

(51) Int. Cl.[7] ..... A63B 69/36; A63B 53/04

(52) U.S. Cl. ..... 473/226; 473/242; 473/288; 473/329; 473/340; 473/236

(58) Field of Search ..... 473/236, 329, 473/332, 342, 330, 331, 288, 226, 242, 251, 340, 350

(56) References Cited

U.S. PATENT DOCUMENTS 1,562,956 * 11/1925 Guerne ..... 473/329
4,121,832 * 10/1978 Ebbing .
4,156,526 * 5/1979 Huggins ..... 473/329
4,422,638 * 12/1983 Tucker ..... 473/329
5,083,778 * 1/1992 Douglass ..... 473/329
5,332,214 * 7/1994 Tucker ..... 473/329
5,407,196 * 4/1995 Busnardo ..... 473/329
5,445,386 * 8/1995 Marshall ..... 473/329
5,458,332 * 10/1995 Fisher ..... 473/329
5,542,675 * 8/1996 Micciche ..... 473/342
5,620,381 * 4/1997 Spalding ..... 473/330
5,718,644 * 2/1998 Donofrio ..... 473/340

* cited by examiner

*Primary Examiner*—Sebastiano Passaniti
(74) *Attorney, Agent, or Firm*—Roger A. Marrs

(57) ABSTRACT

A golf club head with striking surface density control having a club head having a mounting face defining a surface or recess for interchangeably receiving and accepting a selected one of a plurality of pads or inserts, each of which is composed of material having a different density. The mounting face detachably anchors or holds the selected pad or insert in place by screws, clips, adhesive or the like. Guides are provided on the club head for aligning the pad or insert with the mounting face. In one form, the pad or insert may be insertably received within the recess and anchored by fastening or alternately, adhesive may be employed to releasably secure the pad to a flat club surface.

4 Claims, 1 Drawing Sheet

FIG. 2
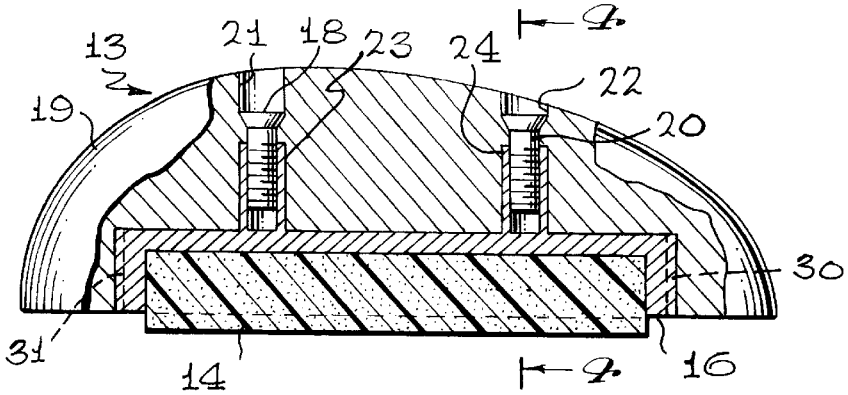
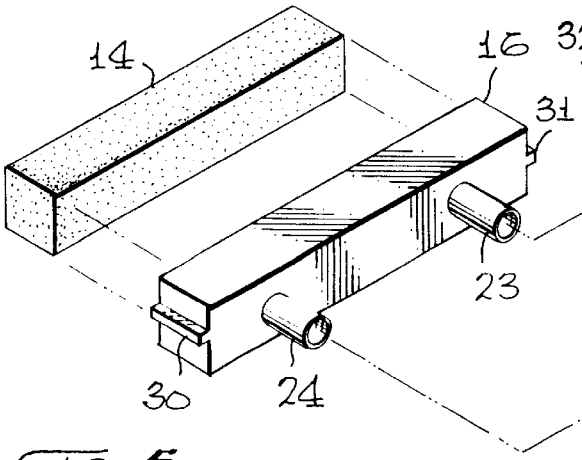
FIG. 5
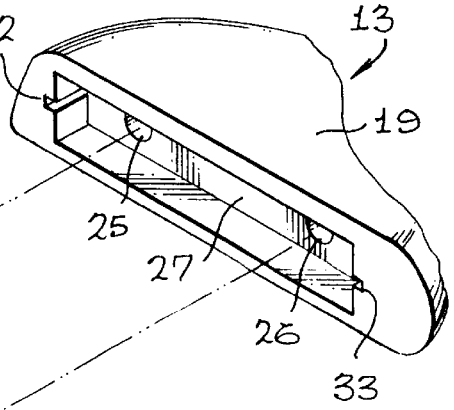
FIG. 3
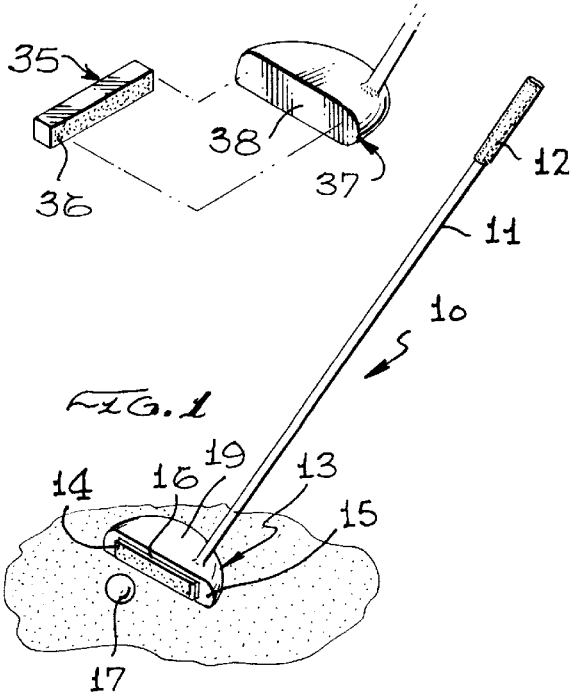
FIG. 1
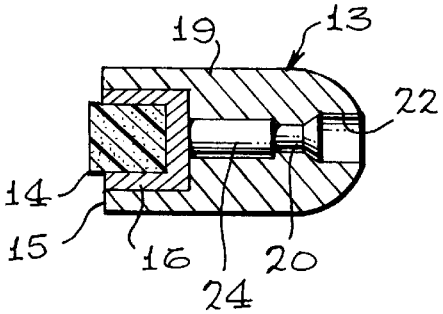
FIG. 4

GOLF CLUB HEAD WITH STRIKING SURFACE DENSITY CONTROL

This application claims priority to Provisional Appln. 60/057,312 filed about Sep. 2, 1997.

BACKGROUND OF THE INVENTION

1. Field of the Invention

The present invention relates to the field of golf, and more particularly to a novel golf club head having an interchangeable cartridge system wherein the golfer may select a cartridge with a golf ball striking surface of a particular density suited for the shot or control factors desired.

2. Brief Description of the Prior Art

During the play of golf, it is important that the golfer have control over the golf club head as it strikes the ball in order to have excellent performance. In using a putter, it is important that the club head have a ball-striking face or surface which provides the golfer a sense of touch and feel so that the ball may be putted with great accuracy. In the play of golf today, many improvements have been made to golf balls which have rendered the balls extremely hard and when struck by conventional putter contact faces or surfaces, the golfer may lose the feel for distance and touch around the target hole.

Therefore, a need has existed to provide a novel striking or contact surface or face for a putter club head which provides the golfer with a sense of touch and a feel for distance even tough hard covered balls are being struck. In some prior instances, a "balata" or soft face has been incorporated as an insert onto putter heads in order to obtain the proper feel on the face of the club head as a ball is struck. The golfer is then able to judge speed in an easier manner and will have better touch and better control over distance. Furthermore, by using a balata rubber face, the ball has a tendency to roll better and long putts end up closer to the cup and shorter putts will roll in.

However, difficulties and problems have been encountered when using club heads which are provided only with a soft or balata rubber insert which stem largely from the fact that the golfer has no way of changing or interchanging the rubber insert and therefore, must either have a multiplicity of putters in order to obtain the choice or selection of material density used at the striking surface. Therefore, a need has existed to provide a golf club head which has a striking surface or contact point which permits a changeable density material to be selectively incorporated into the club head to compensate for the speed of the greens.

SUMMARY OF THE INVENTION

Accordingly, the above problems and difficulties are avoided by the present invention which provides a novel golf club having a club head that will accept a plurality of interchangeable inserts or cartridges, each of which includes a material of different density. In one form of the invention, the club head includes a body having a front face formed with a recess or depression in order to insertably receive one of a selected cartridges. Means are provided for anchoring the cartridge to the body within the recess or depression. Each cartridge includes a material of a specific density and the cartridge includes a carrier for holding the material of specific density so that a portion of the material protrudes forwardly of the front face of the club head. Guide means are provided for registering the cartridge with the recess for easy insertion and removal. The anchoring means can include screws, fasteners, clips or other means of attachment. The material of controlled density resides in the carrier so as to provide an interchangeable cartridge and each cartridge will have different density-striking pads or material.

Therefore, it is among the primary objects of the present invention to provide a novel golf head for a golf club which will readily accept one of a plurality of selected cartridges wherein each cartridge includes a material of different density so that the golfer may have improved and better distance control when a golf ball is struck.

Another object of the present invention is to provide an interchangeable cartridge having different density-striking pads which may be detachably connected to the club head of a golf club.

Another object is to provide a golf head having a front fact with a depression or cavity for insertably receiving a selected insert from a group of inserts of which each insert is composed of different density-striking pads.

A further object of the present invention is to provide a putter club head adapted to receive an interchangeable cartridge selected from a group of cartridges having different density-striking pads.

A further object resides in an interchangeable cartridge having a pad of specific density which may be readily detachably to the front face of a club head by applying an adhesive, fasteners, hook and pile fastening or the like.

Still a further object resides in providing a club head striking pad carried on a disposable cartridge wherein the pad may be composed of silicon, foam, metals, soft or hard rubber or the like.

An object resides in providing a golf club head adapted to mount interchangeable striking pads or inserts to accommodate different golf course greens requiring different ball speeds.

Furthermore, by utilizing interchangeable striking inserts, a player may use his normal stroke to impart travel to the ball.

Also, manufacturers of putters with soft pads must make the pad last the life of the putter, which limits the range of different density materials whereas the interchangeable inserts or pads of this invention are disposable when worn and provide a full range of material densities from the softest to the very hardest.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

FIG. 1 is a perspective view showing a golf club incorporating the novel interchangeable cartridge and pad carried on the club head;

FIG. 2 is an enlarged sectional view of the club head with the interchangeable cartridge and pad;

FIG. 3 is an exploded perspective view showing the construction of the club head with the interchangeable cartridge and pad;

FIG. 4 is a transverse cross-sectional view of the club head taken in the direction of arrows 4—4 of FIG. 2; and FIG. 5 is an exploded view of another version.

DESCRIPTION OF THE PREFERRED EMBODIMENT

Referring to FIG. 1, a golf club is indicated in the general direction of arrow 10 which includes an elongated shaft 11 having a hand grip 12 at one end and a clubhead 13 at the other end. The clubhead is novel and incorporates the present invention that includes a removable pad 14 which is composed of a predetermined dense material. The pad 14 is fitted into the front face 15 of the clubhead by means of a cartridge 16 that is anchored or fastened in place with respect to the body of the clubhead 13. The pad 14 protrudes slightly ahead of the face 15 so as to be in a position to contact a golf ball 17 when the club 10 is swung by a golfer.

Referring now in detail to FIG. 2, a clubhead 13 includes a body 19 which is composed of a solid material and provides a certain amount of weight for the end of the golf club 10. The body 19 includes a detachable or removable cartridge 16 which carries the striking pad 14. The cartridge 16 includes an anchoring or detachable fastening system which includes fasteners 18 and 20 taking the form of screws that are projected through openings 21 and 22 in the backside of body 19 so that the threaded shank of each screw threadably engages with internal threads in sleeves 23 and 24 respectively. The sleeves 23 and 24 outwardly project from the rear of the cartridge 16 and are inserted through openings leading to the access openings 21 and 22.

The openings 21 and 22 communicate with the openings 25 and 26 shown in FIG. 3 which insertably receive the sleeves 23 and 24 respectively. The cartridge 16 is rectangular and provides an elongated opening 26 for receiving the pad. 14. The pad may be secured to the cartridge 16 by an suitable means which may include molding, adhesive or the like. The characteristics of the pad 14 are that the pad is of a known density of material and it is to be understood that each cartridge and pad in a plurality is of different density characteristics. Therefore, the degree of hardness of each of the respective pads in the plurality of cartridges is different and selected at the choice of the golfer for incorporation into the clubhead. The pad may be composed of material chosen from silicon, foam, metals, rubber or the like and attachment of the pad to the cartridge may be of conventional means. However, it is to be understood that the pad and cartridge may be disposable and are not necessarily intended for repeated use.

The cartridge 16 is guided into a receptacle 27 of the body 19 by means of elements 30 and 31 located on opposite sides of the cartridge and which are matable with slots 32 and 33 provided on opposite sidewalls of the elongated recess of depression 27.

The sleeves 23 and 24 are integrally formed with the cartridge 16 and outwardly project from the rear of the cartridge opposite from the opening 26 which is on the front side of the cartridge. The sleeves are arranged in sized spaced-apart parallel relationship.

Referring to FIG. 4, it can be seen that the clubhead 13 seats the cartridge in a snug fashion so as to fully occupy the opening 27. The pad 14 slightly protrudes forward of the front face 15 so as to be in a preferred position for striking the ball 17. Also, it can be seen that access to the screws 20 and 21 can be made through the access openings, such as opening 22, with respect to screw 20.

Therefore, it can be seen that the novel clubhead 13 of the present invention provides a means by which a golfer can readily select a striking pad from a variety of striking pads of different density. Once the selection has been made, the cartridge 16 including the pad 14 can be placed into the opening 27 with the alignment of the guides 30 and 31 with the alignment of the slots 32 and 33. Upon pushing the cartridge into the opening 27, the sleeves 23 and 24 will align with respective openings 25 and 26 and the cartridge will seat into the elongated recess 27 accordingly. The screws 18 and 20 may then be introduced to the access openings 21 and 22 and placed in threadable engagement with the internal bores of the sleeves 23 and 24 respectively. The club 10 may now be used by the golfer with the assurance that he has the best control surface at the contact point of the pad with the ball 17. Thus, the golfer will have improved control so that long putts end up closer to the cup and that short putts will roll into the cup. The golfer is provided with a better touch and feel as he plays on a putting green and the density of the pad 14 can readily accommodate the improved new golf balls which are extremely hard.

FIG. 5 illustrates an alternate version wherein a pad 35 is attached by adhesive 36 to a club head 37 on surface 38.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A golf club with striking surface density control comprising:

a golf club head;

mounting means provided on said club head;

a pad composed of a given material density carried on said mounting means;

said mounting means further including anchoring means for detachably securing said pad to said club head;

said mounting means is a recess within said club head for insertably receiving said pad;

a cartridge holding said pad and adapted to be inserted into said recess;

said anchoring means being screw fasteners coupling said cartridge to said club head;

guide means disposed between said cartridge and said recess for alignment of said cartridge with respect to said recess;

a plurality of said pads and each of said pads composed of a different density; and said pad and cartridge inserted into said recess being selected from said plurality of pads.

2. A golf club head with striking surface density control comprising:

a golf club head having a forward face;

a plurality of ball striking pads, each pad composed of a different density material;

a selected one of said pads releasably disposed on said forward face;

said selected pad substantially occupying said forward face and outwardly projecting therefrom;

guide means cooperatively carried on said selected pad and said club head for aligning said selected pad with said forward face;

a cartridge having an open cavity;

said club head provided with a recess for insertably receiving said cartridge;

said selected pad secured in said open cavity; and said selected pad having a portion extending out of said forward face.

3. The club head as defined in claim 2 including:

fastening means carried on said club head for detachably securing said cartridge therewith.

4. The club head as defined in claim 3 wherein:

said guide means includes said cartridge having opposite ends and said open cavity having opposite ends; and slot and rib means carried on said cartridge opposite ends and said open cavity opposite ends cooperating when aligned and mated with the other to guide said cartridge into said open cavity.

* * * * *